United States Patent [19]

Monte

[11] Patent Number: 4,679,477

[45] Date of Patent: Jul. 14, 1987

[54] PERCUSSIVE ACTION SILENT ELECTRONIC KEYBOARD

[76] Inventor: Charles Monte, 901 E. Walnut Ave., Burbank, Calif. 91501

[21] Appl. No.: 746,844

[22] Filed: Jun. 20, 1985

[51] Int. Cl.[4] ..... G10H 1/34; G10H 1/46

[52] U.S. Cl. ..... 84/1.1; 84/1.27; 84/DIG. 7; 200/5 A

[58] Field of Search ..... 84/1.1, 1.27, DIG. 7, 84/423 R, 433; 200/5 R, 5 A

[56] References Cited

U.S. PATENT DOCUMENTS

| | | | |
|---|---|---|---|
| 3,418,417 | 12/1968 | Rhodes . | |
| 3,935,783 | 2/1976 | Machanian et al. . | |
| 4,044,642 | 8/1977 | Pearlman et al. | 84/1.1 |
| 4,173,166 | 11/1979 | Koepke | 84/DIG. 7 |
| 4,217,803 | 8/1980 | Dodds | 84/1.1 |
| 4,324,164 | 4/1982 | Monte et al. . | |
| 4,512,234 | 4/1985 | Kumano | 84/433 |
| 4,558,623 | 12/1985 | Buchla | 84/1.1 |

*Primary Examiner*—Stanley J. Witkowski
*Attorney, Agent, or Firm*—David B. Harrison

[57] ABSTRACT

A percussive action silent electronic keyboard provides electrical input signals for electronic music synthesis equipment. The keyboard includes a housing, and a keyboard array of a plurality of depressable pivoted playing keys adjacently arranged as a musical keyboard. Each key communicates with a pivoted silent hammer in a cam and follower arrangement. A stop is provided for stopping the momentum of each silent hammer which is caused to move about its pivot by following a camming surface of its corresponding key resulting from depressing of the key during playing action. An electrical switch provided for each key, and the switch is responsive to the playing action of the key for generating and supplying electrical signals indicative of the action to the electronic music synthesis equipment with which said keyboard may be used to generate music.

6 Claims, 2 Drawing Figures

PERCUSSIVE ACTION SILENT ELECTRONIC KEYBOARD

BACKGROUND OF THE INVENTION

The present invention relates to data entry devices for electronic musical sound generating equipment. More particularly, the present invention relates to a silent electronic keyboard which provides the player with the experience of true percussive action during playing and at the same time generates electrical signals corresponding to playing conditions.

Data entry devices for electronic music generators are known in the prior art. Keyboards having preloaded bias force characteristics are commonly encountered as data entry devices for electronic organs, sythesizers and musical sound generating equipment. Such keyboards crudely mimic true percussive action of an acoustical piano keyboard, but deprive the player of the aesthetic experiences uniquely associated with true percussive action keyboards which involve the progressive displacements of multiple masses (key and hammer) in a levered cam and follower arrangement.

Silent practice keyboards are also known to exist in the prior art. Such keyboards were not true percussive action devices, nor did they provide any electrical switch interface for controlling operation of musical and/or percussive sound generators.

With the advent in the musical arts of advanced electronic sound synthesis equipment, and music composed and performed for and with such equipment by musicians trained and experienced in classical accoustical keyboard theory, a need has arisen for an electronic data entry keyboard device which emulates the aesthetic characteristics of true percussive action accoustical keyboard instruments while at the same time generates electronic control signals which are directly related to play in real time.

SUMMARY OF THE INVENTION WITH OBJECTS

A general object of the present invention is to provide a percussive action silent electronic keyboard which overcomes the limitations and drawbacks of the prior art.

Another object of the present invention is to provide a percussive action silent electronic keyboard which may be tailored and adjusted by the player to provide percussive action characteristics within a wide range.

A further object of the present invention is to provide a percussive action silent electronic keyboard which senses multiple characteristics associated with the depression of each key during play, including timing, force, velocity and aftertouch associated with key depression.

One more object of the present invention is to provide a percussive action silent electronic keyboard which may be preprogrammed digitally in order to control multiple synthesizers.

Yet another object of the present invention is to provide a percussive action silent electronic keyboard which is highly portable and compact, which may be manufactured with existing components at low cost, which is easily adjustable and usable by the player, which may be easily adapted to control a wide variety of electronic musical synthesis equipment, and which operates effectively and reliably over a considerable useful life.

These objects are achieved in a percussive action silent electronic keyboard which provides electrical input signals, preferably digital, for electronic music synthesis equipment. The keyboard includes a housing containg a keyboard array of a plurality of depressable pivoted playing keys adjacently arranged as a conventional accoustical instrument musical keyboard. Each key communicates with a pivoted silent hammer in a cam and follower arrangement found in conventional accoustical keyboard instruments. A stopping mechanism stops the momentum of each silent hammer after it has been caused to move about its pivot by following a camming surface of its corresponding key whenever the key is depressed during play.

The keyboard includes an array of electrical switches, with each switch being responsive to the playing action of an associated key. The switch controls programmable electronics in the keyboard which generates electrical signals indicative of playing action and sends such signals in real time to electronic music synthesis equipment with which the keyboard may be used to generate music.

In one aspect of the present invention, each hammer of the keyboard includes a butt portion to which a flexible bridal strap is attached at one end. A leaf spring for each hammer has one end secured to the housing and the other end free, with another end of the bridal strap being attached to the free end of the leaf spring.

In a further aspect of the present invention, the keyboard includes an action adjustment release bar for adjustably engaging the leaf spring adjacent its free end, thereby deflecting the spring from its free standing position toward the hammer and adding to the amount of preload while varying the relative slackness of the bridal strap.

In yet one more aspect of the present invention, the percussive action silent electronic keyboard further includes a first control connected to the adjustment release bar for enabling the player to adjust the position thereof.

In a still further aspect of the present invention, a second control is connected to the leaf spring at its location of attachment to the housing for enabling adjustiment of preload thereto..

In one more aspect of the present invention, the silent electronic keyboard includes a foot pedal control for enabling the player to adjust the position of the action adjustment release bar during playing of the silent keyboard.

In yet one more aspect of the present invention, each key includes an adjustable counterweight for enabling the player to establish key counterweight conditions (inertia) for each key; suited to the player's particular tastes.

In still one more aspect of the present invention, each hammer includes an adjustable counterweight for enabling the player to establish hammer counterweight (inertia) conditions so that each hammer is suited to the player's particular tastes.

In one more aspect of the present invention, the electrical switch array includes an aftertouch sensor for sensing aftertouch of each key and for converting sensed aftertouch to electrical values.

In yet another aspect of the present invention, the electrical switch array includes for each key a ring and button conductive membrane rubber switch which is responsive to each depression therof and may be used to sense the velocity of each depression and therby derive the force thereof.

In still another aspect of the present invention, the electrical switch array is digitally programmable and is adapted to generate and put out electrical signal corresponding to keyboard playing events as a digital data stream in real time.

These and other objects, advantages and features of the present invention will be more fully understood and appreciated by consideration of the following detailed description of a preferred embodiment, presented in conjunction with the accompanying drawings.

DETAILED DESCRIPTION OF A PREFERRED EMBODIMENT

Figure 1:
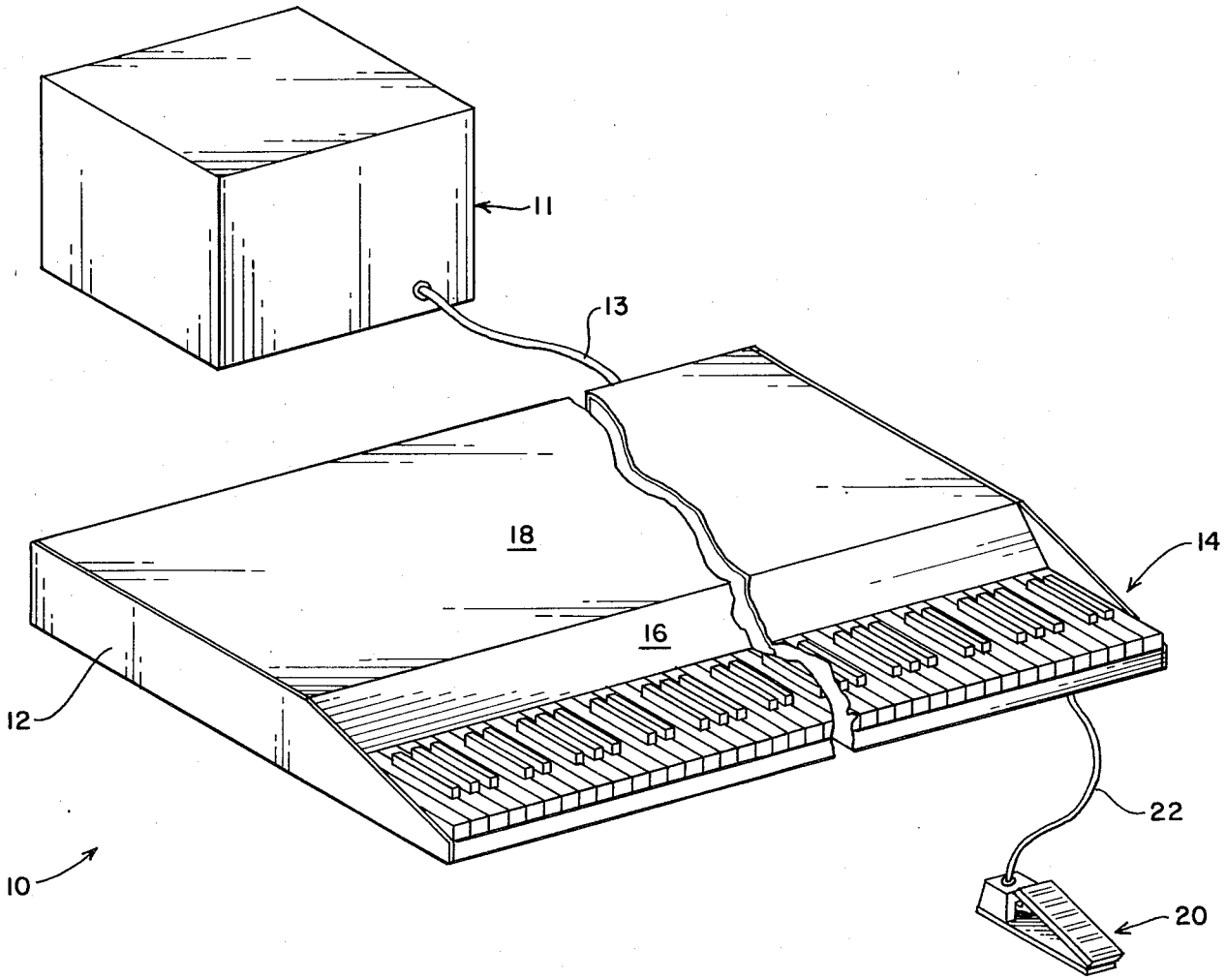
FIG. 1 is a diagrammatic view in perspective of a percussive action silent electronic keyboard incorporating the principles of the present invention, with a transverse break to save drawing room.
Figure 2:
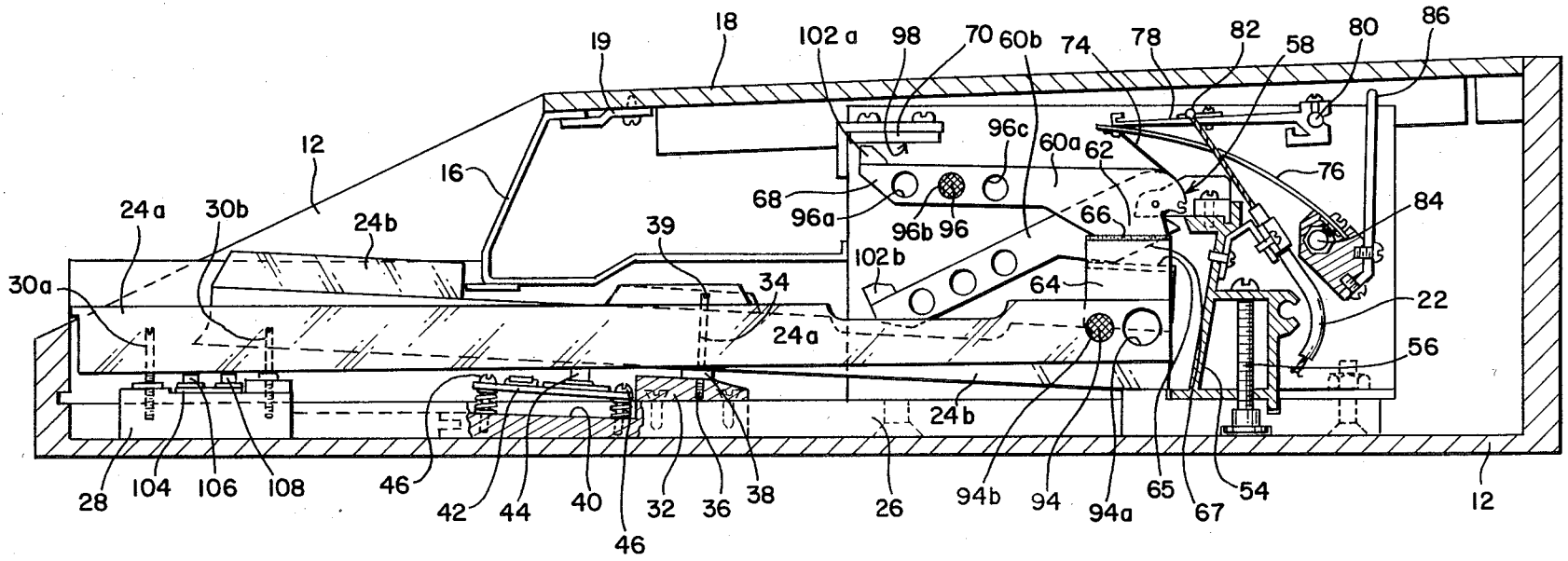
FIG. 2 is a more detailed view in side elevation and section of the FIG. 1 percussive action silent electronic keyboard taken along the line 2—2 in FIG. 1.

A percussive action silent electronic keyboard 10 incorporating the principles of the present invention is depicted in FIGS. 1 and 2. Conventional velocity and aftertouch sensing circuitry inside the keyboard 10 is connected to conventional electronic music synthesis equipment 11 including one or a plurality of electronic synthesizers via a standard electrical interface connection 13 such as the MIDI interface. Therein, the keyboard 10 includes a housing or box 12 which supports, aligns, contains and encloses the elements making up the keyboard 10. A keyboard 14 of 88 playing keys arranged in accordance with accoustical keyboard instrument (piano) convention is exposed along one major edge of the housing 10. An electronic control panel 16 is provided in the housing just above the keyboard 14. A removable top cover or lid 18 is secured to the housing 12 by a suitable latching mechanism 19. A foot pedal assembly 20, connected by a flexible cable 22 to the housing 12, enables the player to control the percussive action characteristics of the keyboard 10, in a manner to be explained hereinafter.

Referring now specifically to FIG. 2, each key 24 is aligned and supported by a key frame 26. A longitudinally disposed front guide pin rail 28 is secured to the key frame 26 by screws and supports an array of front guide pins 30, there being one such pin 30 for each key 24. A longitudinally disposed balance point rail 32 is also secured to the key frame 26 by screws.

An array of adjustable balance pins 34 is carried by the balance point rail 32. Each pin 34 includes a threaded portion 36 with screw threads which are threaded into the balance point rail 32. The rail 32 may be of wood, in which case the threads 36 are of the wood screw type. As an equally acceptable alternative, the balance point rail may be of a suitable lighweight metal alloy, aluminum or magnesium, and the treads 36 may be machined.

Each key 24 is provided with a vertical slot through which the balance point pin 34 extends. The slot has a transverse width slightly greater than the diameter of the pin 24, and a longitudinal length which accomodates freely the range of motion of the key 24 as it pivots about the balance pin 24 during play. A flange portion 38 of the balance pin 34 separates the threaded portion 36 from the main shaft portion of the pin 34 and engages the lower surface a central balance point area of each key 24.

A transverse slot 39 formed in the top of each pin 34 enables the pin to be rotated with a suitable tool, such as a screwdriver, and thereby enables the relative height of each key 24 to be precisely adjusted. This height adjustment is not only appropriate to level the keys of the keyboard 14, it also enables each key 24 to be height aligned relative to electronic switches which sense key action conditions, as explained hereinafter.

A planar shelf region 40 is provided adjacent to the balance point rail 32. This shelf 40 aligns and supports an elongated printed circuit board 42 which carries an array of switches 44. Each switch 44 is directly under a corresponding key 24, so that when the key 24 is depressed, the switch 44 located directly under the particular key becomes actuated.

In the preferred embodiment, each switch 44 is a unitary ring and button conductive membrane unit in which an outer conductive ring first makes bridging contact with an exposed first set of printed circuit traces on the board 42, followed by contact between a central button of the switch 44 bridge contacting a second set of exposed traces. This progressive contact sequence is established by having the outer conductive ring much closer to the first set of traces than the inner central button is to the second set of traces.

When the ring of the switch 44 first bridges the first contacts, a digital timer is started. When the button of the same swithc subsequently bridges the second contacts, the timer is stopped. The time interval between these two events may be rapidly calculated and thereby establishes the velocity with which the key 24 has been depressed, and key velocity is directly analogous to the force with which the key 24 has been depressed. Thus, the keyboard 10 may indicate to the host equipment not only the fact that a key 24 has been depressed but may also signal a weighted value for the particular key which is indicative of the force with which the key 24 has been depressed. This weighting information may then be processed by the host synthesis equipment 11 into an electrical waveform directly analogous (or not so, depending upon programming supplied by the player) to the sound produced by an accoustical instrument having a key struck with the same velocity and force.

A longitudinally disposed action rail 54, generally parallel with the front guide pin rail 28 and with the balance point rail 32 is formed as an extrusion of suitable metal alloy. The rail 54 includes screws 56 which secure the rail to the key frame 26. A flanged hinge assembly 58 is provided for each key 24, and each hinge assembly 58 is secured to the action rail 54 by screws. The hinge assembly 58 provides a journal for each hammer 60, there being one hammer associated with each key 24. Each hammer 60 includes a butt region 62 which is contacted by a raised end member 64 of its corresponding key, in a cam and follower arrangement as shown in FIG. 2 wherein an upwardly facing contact surface 65 of the raised end member 64 is the cam and a downwardly facing contact surface 67 of the butt region 62 is the follower. In FIG. 2, two hammers **24*a* and 24*b* are shown in detail. The white key 24*a*** is shown in a depressed or "key down" position which it would occupy when played by the player, while an adjacent black key 24*b*, located immediately behind the key 24*a*, and therefor shown partially in hidden view, is in its at-rest or "key-up" position. The hammer 60*a*, which follows the key 24*a*, is shown in its striking position, whereas an adjacent hammer 60*b*, which follows the key 24*b* and which is directly behind the hammer 60*a*, is shown in its at-rest or non-striking position. A felt pad 66 between the cam and follower surfaces 65, 67 facilitates a smooth transfer of force from each key 24 to its respective hammer 60.

When the key 24 is depressed, its levered raised end member 64 moves upwardly and imparts an upward force upon the butt region 62 of the corresponding hammer 60. This transferred force causes the hammer 60 to move upwardly, until a hammer head region 68 encounters a longitudinally extending stop rail 70 blocking its path. The rail 70 brings the hammer silently to a stop. Meanwhile, this arrangement has provided a truly percussive action which has been experienced by the player at the keyboard 14.

A flexible bridal strap 74 is connected at one end to the butt end 62 of the hammer 60, and is connected at its other end to a free end of a leaf spring 76, which applies a controlled amount of bias force to the hammer to resist the upward movement thereof during playing action. A longitudinally disposed, action adjustment release bar 78 contacts all of the leaf springs 76 and pushes the free ends thereof toward the butt ends 62 of the hammers. This action releases the bias force applied by the leaf spring 76 through the bridal strap 74 to each hammer 60, thereby freeing up the hammer action as each bridal strap 74 slackens.

In the illustrated embodiment, the action adjustment release bar 78 is pivoted at a longitudinal journal 80 mounted to the box frame 12. The foot pedal 20 may be connected by the cable 22 to a pedal cable connection 82 and thereby enable the player to adjust the position of the action adjustment release bar 78 during play.

The leaf spring 76 is also preferably mounted to the box 12 at a longitudinal journal 84. This journal 84 may be connected to a leaf spring adjustment lever 86 in order to rotate the common leaf spring journal 84 and thereby provide the player with the ability to adjust the initial tension applied commonly to each leaf spring 76. This feature adds a second adjustment which is provided to the player, and it may also be connected by a cable to a second foot pedal (not shown), or to a control handle accessible at the control panel 16.

A series of adjustable mass-adding weights is provided for the silent keyboard 10. Weights 94 are provided for inclusion in the key 24 adjacent to the raised, hammer engaging portion 64. Several positions 94*a*, 94*b* are provided. A single weight 94 may be placed in either of the positions 94*a*, 94*b*, or two weights may be used in both positions, or no weights used. The weights 94 are provided with a knurled cylindrical outer surface and fit snugly, but removably within each position 94. One or more weights 96 may be added to the hammer 60 at any of three positons 96*a*, 96*b*, and 96*c* provided along the pendulum of the hammer 60. One weight 94 is shown by cross hatching to be inserted in position 94*b*, and one weight 96 is shown by cross hatching to be inserted in positon 96*b*. The weights 94, 96 may be added, moved and/or removed by the player to adjust the action to the touch characteristics most preferred. Access to each hammer and key is through the top cover 18.

In addition to, or in lieu of the ring and button switches 44 provided for each key 24, the hammer 60 may be provided with a conductive elastomeric pad 102 having a convex outer contour. This pad 102 may be positioned to strike an exposed printed circuit electrical pattern 100 mounted on the hammer stop rail 70 in a position to face the pad. The printed circuit contact pattern may be of the bullseye style, so that the amount of force of the hammer controls the amount of compression of the pad 102 and resultant flattening distortion of the pad 102. The more the pad 102 becomes distorted, the more contacts are bridged, thereby enabling generation in the synthesis unit 11 of an accurate electrical analog of contact force of each hammer.

The keyboard 10 may also be provided with a second longitudinal printed circuit board 104 disposed directly under the playing surface of the keyboard 14. This circuit board 104 may carry a series of swiches 106 (white keys), 108 (black keys) for sensing and signalling aftertouch, (a key down condition following the striking of the key to provide musical sustain of selected notes only during play).

All of the electrical signals generated at the silent keyboard 10 by operation of the switches 44, 98 and 106-108 are sent to a suitable conventional digital controller which responds to the signals by generating digital control words which may be sent to e.g. digital musical sound synthesizers 11. These words are sent preferably via a musical instrument digital interface (MIDI) connection 13 to the musical synthesis equipment 11.

While the apparatus and method of the present invention have been summarized and explained by an illustrative embodiment of a percussive action silent electronic keyboard for controlling musical synthesis equipment, it will be readily apparent to those skilled in the art that many widely varying embodiments and applications are within the teaching and scope of the present invention, and that the example presented herein is by way of illustration only and should not be construed as limiting of the scope of this invention.

I claim:

1. A percussive action silent electronic keyboard for play as a musical instrument and providing electrical input signals for electronic music synthesis equipment which generates music electronically in response to play action of the keyboard, said keyboard comprising:

a housing;

a keyboard array of a plurality of depressable pivoted playing keys adjacently arranged as a musical keyboard, each said key communicating with a pivoted, freely moveable silent hammer in a cam and follower arrangement, each said hammer comprising a butt portion and a flexible bridal strap attached at one end to said butt portion, and further including a leaf spring having one end secured to said housing and the other end free, another end of said bridal strap being attached to said free end of said leaf spring, stop means for stopping the momentum of each silent hammer which is caused to move freely about its pivot in a limited arc from a rest position to an impact position by following a camming surface of its corresponding key resulting from depressing of the key during playing action, electrical switch means responsive to the playing action of said key for generating and supplying electrical signals indicative of said action to said electronic music synthesis equipment with which said keyboard may be used to generate music.

2. The percussive action silent electronic keyboard of claim 1 further including an action adjustment release bar for adjustably engaging said leaf spring adjacent its free end, for thereby deflecting said spring from its free standing position and adding to the amount of preload and for simultaneously controlling the proximity of said free end to said butt portion and the relative slackness of said bridal strap.

3. The percussive action silent electronic keyboard of claim 2 further including first player control means connected to said action adjustment release bar for enabling its position to be adjusted by the player.

4. The percussive action silent electronic keyboard of claim 2 further including adjustment means connected to said leaf spring at its location of attachment to said housing for enabling adjustment of preload of said leaf spring.

5. The percussive action silent electronic keyboard of claim 2 further comprising foot pedal means and wherein said action adjustment release bar is connected to said foot pedal means for enabling the player to adjust the position of said action adjustment release bar during playing of the silent keyboard.

6. The percussive action silent electronic keyboard of claim 1 wherein each said key includes adjustable counterweight means for enabling the player to establish key counterweight conditions for each key suited to the player's particular tastes.

* * * * *